United States Patent [19]

Lash et al.

[11] 4,367,099

[45] Jan. 4, 1983

[54] TRIVALENT CHROMIUM PASSIVATE PROCESS

[75] Inventors: Ronald J. Lash, Rochester; David E. Crotty, Highland Park, both of Mich.

[73] Assignee: Occidental Chemical Corporation, Warren, Mich.

[21] Appl. No.: 273,526

[22] Filed: Jun. 15, 1981

[51] Int. Cl.[3] ..... C23F 7/00

[52] U.S. Cl. ..... 148/6.2; 148/6.21

[58] Field of Search ..... 148/6.2, 6.21, 6.16

[56] References Cited

U.S. PATENT DOCUMENTS

| | | | |
|---|---|---|---|
| 2,548,420 | 4/1951 | Chester et al. | 148/6.2 |
| 3,368,928 | 2/1968 | Chadha et al. | 148/6.2 |
| 3,687,740 | 8/1972 | Pearlstein et al. | 148/6.27 |
| 3,932,198 | 1/1976 | Schneider | 148/6.2 |
| 4,171,231 | 10/1979 | Bishop et al. | 148/6.21 |

*Primary Examiner*—Sam Silverberg

*Attorney, Agent, or Firm*—Richard P. Mueller

[57] ABSTRACT

A process for treating metal surfaces, particularly zinc and zinc alloy surfaces, for depositing a passivate film of improved corrosion resistance and hardness which comprises the steps of providing an aqueous acidic solution containing effective amounts of chromium ions substantially all of which are in the trivalent state, hydrogen ions to provide a pH of about 1.2 to about 2.5, an oxidizing agent, and at least one additional metal ion selected from the group consisting of iron, cobalt, nickel, molybdenum, manganese, aluminum, lanthanum, cerium, lanthanide mixtures as well as mixtures thereof, contacting the substrate with said aqueous acid solution for a period of time sufficient to form a passivate film thereon, preferably water rinsing the passivated substrate, thereafter contacting the passivated substrate with a dilute aqueous rinse solution for a period of at least one second containing a bath compatible water soluble inorganic and/or organic silicate compound present in an amount effective to impart improved corrosion resistance and hardness to the passivate film, and drying the silicate rinsed substrate.

28 Claims, No Drawings

TRIVALENT CHROMIUM PASSIVATE PROCESS

BACKGROUND OF THE INVENTION

A variety of chromium containing aqueous solutions have heretofore been used or proposed for treating zinc, zinc alloy, cadmium and cadmium alloy surfaces for improving the corrosion resistance properties thereof and to further enhance the appearance of such surfaces by imparting a yellow or a blue-bright coating thereto, the latter simulating a chromium finish. Such treating solutions originally contained chromium in the hexavalent state and in more recent years the chromium constituent was present as a mixture of the hexavalent and trivalent forms. The reduced toxicity of trivalent chromium and the increased simplicity and efficiency in treating waste effluents containing trivalent chromium has occasioned an increased commercial use of treating solutions in which the chromium constituent is substantially entirely in the trivalent state. Such prior art trivalent chromium passivating solutions have been found to be somewhat less effective than the hexavalent chromium passivate solutions in imparting good corrosion resistance to the zinc, zinc alloy, cadmium and cadmium alloy surfaces treated and there has, accordingly, been a continuing need for further improvement in trivalent chromium passivate processes.

The foregoing problem has been further aggravated by a conversion from conventional cyanide zinc and cadmium plating processes to acid and alkaline non-cyanide electroplating baths which produce metal deposits which are not as receptive to chromium passivate treatments.

Typical of prior art compositions and processes for treating zinc and zinc alloy surfaces are those disclosed in U.S. Pat. Nos. 2,393,663; 2,559,878; 3,090,710; 3,553,034; 3,755,018; 3,795,549; 3,880,772; 3,932,198; 4,126,490; 4,171,231; British Pat. Nos. 586,517 and 1,461,244; and German Pat. No. 2,526,832.

While improvements have been made in trivalent chromium passivate compositions and processes to produce commercially acceptable passivate films, such films as initially formed have been found in some instances to lack sufficient initial hardness to enable handling of the substrate through further work stages without encountering damage to passivate film. Additionally, such trivalent chromium passivate compositions and processes have also been found in some instances to lack optimum corrosion resistance, hardness and durability, and produce films which are somewhat cloudy and lack optimum clarity from an appearance standpoint.

The present invention provides a process which is effective to impart improved corrosion resistance to zinc, zinc alloy, cadmium and cadmium alloy, as well as aluminum and magnesium surfaces and to impart a desirable surface finish which can range from a clear bright to a light blue-bright to a yellow iridescent appearance, which produces a passivate film of improved corrosion resistance, hardness, durability, clarity and initial hardness, which process is simple to control and operate and which is of efficient and economical operation.

SUMMARY OF THE INVENTION

The benefits and advantages of the present process are achieved by providing an aqueous acidic treating solution containing as it essential constituents, chromium ions substantially all of which are present in the trivalent state at a concentration of from about 0.05 grams per liter (g/l) up to saturation, hydrogen ions to provide a solution pH of about 1.2 to about 2.5 which can be conveniently introduced by mineral acids such as sulfuric acid, nitric acid, hydrochloric acid or the like, an oxidizing agent of which hydrogen peroxide itself is preferred present in an amount of about 1 to about 20 g/l, at least one additional metal ion selected from the group consisting of iron, cobalt, nickel, molybdenum, manganese, aluminum, lanthanum, cerium and lanthanide mixtures, as well as mixtures thereof present in an amount effective to activate the bath and formation of a chromium passivate film of the desired appearance on the substrate treated. The solution may optionally contain halide ions for imparting additional hardness to the coating, a wetting agent, and a bath soluble compatible organic carboxylic acid present in an amount effective to further impart initial hardness and clarity to the passivate film.

In accordance with the process of the present invention, zinc, cadmium or zinc alloy or cadmium alloy surfaces are contacted with the aqueous acidic treating solution preferably at a temperature ranging from about 40° to about 150° F., preferably from about 70° to about 90° F. for a period of time typically ranging from about 10 seconds to about one minute to form the desired passivate coating thereon, the passivate surfaces are water rinsed and thereafter contacted with a dilute aqueous silicate solution at a temperature of about 50° to about 150° F. for a period of time usually ranging from about one second up to about one minute or more whereafter the surfaces are air dried.

Additional benefits and advantages will become apparent on a reading of the Description of the Preferred Embodiments taken in conjunction with the examples provided.

DESCRIPTION OF THE PREFERRED EMBODIMENTS

The present invention is particularly applicable but not limited to the treatment of alkaline and acidic non-cyanide zinc electrodeposits to impart improved corrosion resistance and a decorative appearance to the treated substrate. Particularly satisfactory results are obtained on decorative zinc electrodeposits of the bright and semi-bright types although beneficial effects are also achieved on zinc and zinc alloy substrates such as galvanized substrates, zinc die castings and substrates comprised of cadmium or alloys of cadmium predominantly comprised of cadmium. While the invention as herein described is particularly directed to the treatment of zinc and zinc alloy surfaces, it has been observed that beneficial results are also obtained in the treatment of aluminum, aluminum alloy, magnesium and magnesium alloy surfaces to form a passivate film or coating thereon. Accordingly, the present invention in its broad sense is directed to the treatment of metal surfaces which are receptive to the formation of a passivate film thereon when contacted with the solution of the present invention in accordance with the process parameters disclosed.

In the case of decorative zinc electroplatings, a further enhancement of the appearance of such substrates in addition to the corrosion resistance imparted is achieved by the passivate film which ranges from a clear bright to a light blue bright appearance simulating that of a chromium deposit or alternatively, a clear light-yellow appearance simulating that obtained by use of prior art hexavalent chromium solutions.

In accordance with the present process, a treating solution is provided which contains as its essential constituents, chromium ions which are present substantially all of the trivalent state, hydrogen ions to provide a pH of from about 1.2 to about 2.5, an oxidizing agent in an amount effective to activate the hydrated trivalent chromium to form a chromate film on the metal surface, at least one additional metal ion selected from the group consisting of iron, cobalt, nickel, molybdenum, manganese, aluminum, lanthanum, cerium and lanthanide mixtures of rare earth metals as well as mixtures thereof present in an amount effective to impart integral hardness to the gelatinous chromate film. The treating solution may optionally further contain halide ions including fluoride, chloride and bromide ions for further increasing the hardness of the passivate film, one or more compatible wetting agents for achieving efficient contact with the substrate being treated, and a bath soluble and compatible organic carboxylic acid present in an amount effective to further impart initial hardness and clarity to the passivate film of the structural formula:

$$(OH)_aR(COOH)_b$$

wherein:

a is an integer from 0 to 6;

b is an integer from 1 to 3; and

R is an alkyl, alkenyl, or aryl containing from $C_1$ to $C_6$ carbon atoms; as well as the bath soluble and compatible salts thereof.

The trivalent chromium ions can be introduced in the form of any bath soluble and compatible salt such as chromium sulfate [$Cr_2(SO_4)_2$], chromium alum [$KCr(SO_4)_2$], chromium chloride [$CrCl_3$], chromium bromide [$CrBr_3$], chromium fluoride [$CrF_3$], chromium nitrate [$CrNO_3$], or the like. The trivalent chromium ions can also be introduced by a reduction of a solution containing hexavalent chromium ions employing an appropriate reducing agent of any of the types well known in the art to effect a substantially complete stoichiometric reduction of all of the hexavalent chromium to the trivalent state.

The concentration of the trivalent chromium ions in the treating solution may range from as low as about 0.05 g/l up to saturation with quantities of about 0.2 to 2 g/l being preferred. Typically, the operating bath contains from about 0.5 to about 1 g/l trivalent chromium ions.

The treating bath contains hydrogen ions in an amount to provide a pH of about 1.2 to about 2.5 with a pH range of about 1.6 to about 1.8 being preferred for producing clear to light-blue passivate films and a pH of about 1.5 to about 2.0 for yellow passivate films. Acidification of the operating bath to within the desired pH range can be achieved by a variety of mineral acids and organic acids such as sulfuric acid, nitric acid, hydrochloric acid, formic acid, acetic acid, propionic acid and the like of which sulfuric acid and nitric acid are preferred. The presence of sulfate ions in the bath has been found beneficial in achieving the desired passivation of the substrate and can be introduced by the sulfuric acid addition or sulfate salts or the other bath constituents. Sulfate ion concentrations can range in amounts up to about 15 g/l with amounts of about 0.5 to about 5 g/l being preferred.

The treating bath further contains an oxidizing agent or agents which are bath compatible of which peroxides including hydrogen peroxide and metal peroxides such as the alkali metal peroxides are preferred. Hydrogen peroxide itself of a commercial grade containing about 25% to about 60% by volume peroxide constitutes the preferred material. Other peroxides that can be employed include zinc peroxide. Additionally, ammonium and alkali metal persulfates have also been found effective as oxidizing agents.

The concentration of the oxidizing agent or mixture of oxidizing agents is controlled to achieve the desired surface appearance of the treated substrate. Typically, the concentration of the oxidizing agent can range from about 1 to about 20 g/l with an amount of about 3 to about 7 g/l being preferred calculated on a weight equivalent effectiveness basis to hydrogen peroxide.

In addition, the bath further contains at least one additional metal ion selected from the group consisting of iron, cobalt, nickel, molybdenum, manganese, aluminum, lanthanum, cerium, lanthanide mixtures as well as mixtures thereof. The foregoing metal ions or mixtures of metal ions are conveniently introduced into the bath by way of bath soluble and compatible metal salts including the sulfates, nitrates, halide salts, or the like. For economic reasons, the lanthanum ions are introduced not as a pure lanthanum compound, but as a mixture of the rare earth salts of the metals of the lanthanide series, (hereinafter designated as "lanthanide mixture") which contains lanthanum compounds as the predominant constituent. A commercially available lanthanide mixture which is suitable for use in the practice of the present invention is Lanthanum—Rare Earth Chloride, product code 5240, available from Molycorp, Inc. of White Plains, N.Y. This product has the general formula La-$RECl_3.6H_2O$ and is available as a solution containing about 55 to 60% by weight solids. The solution is prepared from a rare earth oxide (REO) concentrate containing a minimum of 46% by weight total REO comprising about 60% lanthanum oxide ($La_2O_3$), 21.5% neodymium oxide ($Nd_2O_3$), 10% cerium oxide ($CeO_2$), 7.5% praseodymium oxide ($Pr_6O_{11}$) and 1% of residual REO. The presence of such other rare earth metals in the solution does not appear to have any adverse effect at the low concentrations in which they are present and may further contribute to the activation of the treating solution in forming the passivate film.

The foregoing metal ions or combinations thereof with the exception of cerium ions are employed for producing a clear to a light-blue passivate film. When a light-yellow iridescent passivate film is desired, cerium ions are employed, preferably in combination with one or more of the other metal ions to produce a passivate film simulating in appearance the light yellow passivate films heretofore obtained employing hexavalent chromium passivating solutions which have been recognized and embodied in ASTM specifications in view of their characteristic color and associated excellent corrosion resistance. The cerium ions can be introduced in the form of any bath soluble and compatible cerium salt including cerium sulfate [$Ce(SO_4)_2.4H_2O$]; halide salts such as cerous chloride [$CaCl_3.6H_2O$]; nitrate salts such as cerium nitrate [$Ce(NO_3).5H_2O$], [$Ce(NO_3)_3(OH).3H_2O$] and the like.

Usually, at least some of the cerium ions are introduced into the bath in the tetravalent state to impart the characteristic yellow color of the tetravalent cerium ion into the passivate film. Certain oxidizing agents such as hydrogen peroxide, act as a reducing agent under the acid conditions prevalent in the bulk of the operating bath and reduce some of the tetravalent cerium ions to the trivalent state. However, oxidizing agents such as hydrogen peroxide revert from a reducing agent to an oxidizing agent at the interface of the substrate being treated due to the higher pH prevalent at the interface and oxidize at least some of the trivalent cerium ions to the tetravalent state which are deposited in the film and impart the characteristic yellow color thereto. When using such oxidizing agents as hydrogen peroxide, accordingly, all of the cerium ions can, if desired, be initially introduced into the operating bath in the trivalent state of which a portion are oxidized to the tetravalent state at the interface of the substrate. The passivate film usually contains a mixture of trivalent and tetravalent cerium compounds and the intensity of the yellow color of the film is dictated by the concentration of tetravalent cerium compounds present. The cerium sulfate compound, due to solubility difficulties, is preferably added to the bath in the form of an acid solution such as a sulfuric acid solution containing the cerium sulfate dissolved therein.

The concentration of cerium ions in the operating bath can range from about 0.5 up to about 10 g/l with concentrations of from about 1.0 to about 4.0 g/l being preferred. The concentration of cerium ions is in part influenced by the magnitude of the yellow coating desired and higher concentrations of the cerium ions produce corresponding increases in the yellow color of the passivate film.

Because of cost considerations, the cerium ions are preferably introduced as a commercially available mixture of rare earth salts of metals in the lanthanide series which contains cerium compounds as the principal component. One such commercially available material is a cerous chloride solution containing about 46% solids of which $CeCl_3.6H_2O$ predominates. The cerous chloride solution is derived from a rare earth oxide (REO) concentrate solid by Molycorp, Inc. of White Plains, New York under product code 5310 containing a minimum of 99 percent total REO of which $CeO_2$ is 96%, $La_2O_3$ is 2.7%, $Nd_2O_3$ is 1% and $Pr_6O_{11}$ is 0.3%. A ceric sulfate solution is commercially available from the same source containing about 42% solids of which $Ce(SO_4)_2.H_2O$ predominates and which is also prepared from product code 5310 containing other rare earth metal compounds in similar minor amounts.

The concentration of the additional metal ions other than cerium ions for appropriate activation of the treating bath to produce a clear to blue-bright appearance is controlled to provide a concentration ranging from about 0.02 up to about 1 g/l with concentrations of from about 0.1 to about 0.2 g/l being preferred. While such metal ions can be used in concentrations above 1 g/l, such as, up to 10 g/l, the use of such higher concentrations even in the absence of cerium ions tends to produce dull films of a yellow tint rather than the desired clear or light-blue films. For this reason, such higher concentrations are undesirable from an appearance standpoint.

Optionally, but preferably, the operating bath may contain an organic carboxylic acid or salt thereof of the structural formula as hereinbefore set forth present in an amount effective to impart increased clarity and initial hardness to the gelatinous chromate film deposited. The improvement in clarity of the film is particularly pronounced in connection with the light-yellow iridescent films produced from cerium ion containing solutions. The particular concentration or range of concentrations of the clarity/hardness agent will vary in proportion to molecular weight of the particular acid and/or metal salt employed with higher concentrations required or an equivalent effectiveness as the molecular weight of the additive agent increases. The particular concentration to achieve optimum clarification and hardness is also dictated to some extent by the concentration of the other metal ions present in the bath with higher concentrations being used as the metal ion concentrations increase. Generally, the organic carboxylic acid additive agent or metal salts thereof can be employed in amounts ranging from about 0.05 up to about 4.0 g/l with concentrations of about 0.1 to about 1.0 g/l being usually preferred.

The additive can be introduced as the organic acid itself or as any bath soluble and compatible metal salt including the alkali metal salts, ammonium salts and salts of the several additional metal ions in the bath. For economic reasons, the organic acid is usually introduced as an acid or as the sodium or potassium salt thereof.

Within the scope of the structural formula as hereinabove set forth, organic carboxylic acids which have been found particularly suitable include malonic, maleic, succinic, gluconic, tartaric and citric, of which succinic or succinate salts have been found particularly effective.

As a further optional but preferred constituent, the bath contains halide ions including chloride, bromide and fluoride ions which have been found to enhance the hardness of the passivate film on the treated substrate. The halide ions or mixture thereof can conveniently be introduced employing any of the alkali metal and ammonium salts thereof as well as salts of the metal ions hereinabove set forth. The concentration of the total halide constituent in the bath normally may range up to about 2 grams per liter with concentrations of about 0.1 to about 0.5 g/l being typical.

In addition to the foregoing, the use of a small effective amount of a variety of bath compatible wetting agents also provides beneficial results in the nature of the passivate film deposited. When employed the wetting agent can be present in concentrations up to about 1 gram per liter (g/l) with concentrations of about 50 to about 100 mg/l being preferred. Wetting agents suitable for use in the treating bath include aliphatic fluorocarbon sulfonates available from 3M under the Fluorad brandname, such as, for example, Fluorad FC 98, which is a nonfoaming wetting agent and its use at about 100 mg/l in the working bath improves the color and hardness of the passivate film. A second class of suitable wetting agents is the sulfo derivatives of succinates. An example of this class is Aerosol MA-80 which is a dihexyl ester of sodium sulfosuccinic acid and is commercially available from American Cyanamid Company. A third class of suitable wetting agents is the sulfonates of naphthalene which are linear alkyl naphthalene sulfonates, such as Petro Ba, for example, available from Petrochemical Company.

The operating bath can be conveniently prepared by employing a concentrate containing the active constituents with the exception of the oxidizing agent and cerium ions, if used, which is adapted to be diluted with water to form a bath containing the constituents within the desired concentration range. Similarly, replenishment of the bath on a continuous or intermittent basis can be achieved employing a concentrate of the active constituents with the exception of the oxidizing agent and cerium ions, if use, which is added separately to the operating bath. Typically, a bath make-up concentrate can contain from about 10 to about 80 g/l chromium ions, from about 1.0 to about 80 g/l of the organic carboxylic acid and/or salt additive agent, from about 5 to about 50 g/l of at least one additional metal ion of the group consisting of iron, cobalt, nickel, molybdenum, manganese, aluminum, lanthanum, lanthanide mixture or mixtures thereof, halide ions up to about 50 g/l and a suitable surfactant in an amount up to about 5 g/l if employed. Such a make-up concentrate is adapted to be diluted with about 98 volume percent water to produce an operating bath containing the active constituents within the ranges specified. The oxidizing agent such as hydrogen peroxide, for example, is separately introduced into the bath preferably in a form commercially available containing from about 35 to 40 percent by volume hydrogen peroxide. The cerium ions, when employed, are preferably introduced in the form of an aqueous acid solution of cerous chloride or ceric sulfate having cerium ion concentration of from about 200 to about 320 g/l and about 60 to about 100 g/l, respectively. Such cerium concentrates may be conveniently comprised of the commercially available materials hereinbefore described available from Molycorp, Inc.

In accordance with the process of the present invention, a treating bath formulation as hereinabove described is applied to a substrate to be treated by spray, immersion, flooding or the like for a period of time sufficient to form the desired passivate film thereon. The treating solution is preferably controlled within a temperature range of about 40° to about 150° F., with about 70° to about 90° F. being preferred. Temperatures above about 90° F. have a tendency to cause a rapid loss of peroxide-type oxidizing agents when used whereas temperatures below about 70° F. reduce the activity of the bath requiring increased contact times to achieve a passivate film of the same thickness or color intensity as can be achieved at the higher temperatures at shorter time intervals. Typically, contact times of about 20 seconds to about 1 minute are satisfactory with contact times of about 30 seconds being usually preferred.

Following the passivation treatment, the substrate is preferably subjected to one or a plurality of water rinse steps which may be at room temperature or at elevated temperatures whereafter the passivated substrate is contacted with a dilute aqueous silicate solution in the form of a final rinse step. The contact time of the passivated substrate with the silicate solution may range for a period of at least about one second up to about one minute or longer and the silicate solution may range in temperature from about 50° up to about 150° F. Following the silicate rinse step, the substrate is dried such as by circulating hot air, for example.

The aqueous silicate rinse solution contains as its essential constituent, a bath soluble and compatible inorganic or organic silicate compound as well as mixtures thereof present in an amount of about 1 to about 40 g/l, and preferably from about 5 to about 15 g/l calculated as $SiO_2$. Inorganic silicates suitable for use in the practice of the present process include alkali metal and ammonium silicates of which sodium silicate [$Na_2O.xSiO_2$(x=2–4)] and potassium silicate [$K_2O.ySiO_2$(y=-3–5)] are preferred for economic reasons. Organic silicates which can also be satisfactorily employed include quaternary ammonium silicates which include tetramethylammonium silicate, phenyltrimethylammonium silicate, disilicate and trisilicate, and benzyltrimethylammonium silicate and disilicate. Such silicates meeting the purposes of this invention are expressed by the following general formula:

$$ROR':xSiO_2:yH_2O$$

where R is a quaternary ammonium radical substituted with four organic groups selected from the groups alkyl, alkylene, alkanol, aryl, arkylaryl or mixtures thereof, where R′ is either R or hydrogen, where x equals 1 to 3 and where y equals 0 to 15.

Such water soluble organic silicates including their synthesis and characterization is more fully described in literature such as the article by Merrill and Spencer, "Some Quaternary Ammonium Silicates", published in the Journal of Physical and Colloid Chemistry, 55, 187 (1951), the substance of which is incorporated herein by reference. Similar silicates including typical synthesis thereof is disclosed in U.S. Pat. No. 3,993,548 to which reference is also made for further details.

Because of the relatively higher cost of such organic silicates, the silicate rinse solution is preferably comprised of inorganic silicates of which the potassium and sodium silicates as hereinabove described are particularly preferred.

In addition to the silicate compound the silicate rinse solution can optionally contain a bath soluble and compatible wetting agent for enhancing contact with the passivated surface present in conventional amounts of about 0.05 up to about 5.0 g/l. The silicate rinse may also optionally include an emulsifiable organic substance such as an emulsifiable oil present in an amount of from about 1 up to about 50 g/l to provide an oily film on the non-electroplated interior surfaces of ferrous substrates to provide temporary protection against rusting during further processing steps of the parts. When such parts have surfaces which are completely passivated such as, for example, zinc die castings, the use of the optional emulsifiable oil is not necessary.

Similarly, there are applications where an oil is not desired but temporary rust protection of interior unplated surfaces is still required. In these cases a final rinse containing an alkali metal or ammonium nitrite such as sodium nitrite in the amounts of about 0.1 to about 1.0 gm/l is used. In addition a wetting agent or combination of wetting agents is used in conjunction with the sodium nitrite in the amounts of about 0.05 to about 5.0 gm/l. The presence of silicates in the final rinse is also compatible with this treatment.

In order to further illustrate the present invention, the following examples are provided. It will be understood that the examples are provided for illustrative purposes and are not intended to be limiting of the scope of the invention as herein disclosed and as set forth in the subjoined claims.

EXAMPLE 1

An operating bath suitable for depositing a yellow passivate film on a receptive substrate is provided by forming a trivalent chromium containing concentrate designated as "Concentrate A" having a composition as follows:

| CONCENTRATE A | |
|---|---|
| Ingredient | Concentration, g/l |
| $Cr^{+3}$ | 25 |
| Ferric ammonium sulfate | 30 |
| Sodium chloride | 20 |
| Nitric acid (100%) | 60 |
| Succinic acid | 20 |

A cerium ion concentrate is provided containing about 80 g/l ceric ions in the form of ceric sulfate in a dilute (about 5%) sulfuric acid solution. An oxidizing agent concentrate is also provided containing about 35% hydrogen peroxide.

The yellow passivate operating bath is prepared comprising water containing 2% by volume of Concentrate A, 2% by volume of the cerium ion concentrate and 2% by volume of the oxidizing agent concentrate.

A silicate aqueous rinse solution is provided containing 10 g/l sodium silicate calculated as $SiO_2$.

Steel test panels are subjected to an alkaline, non-cyanide electroplating step to deposit a zinc plating thereon after which they are thoroughly water rinsed and immersed with agitation in the passivate operating bath for a period of about 30 seconds at a temperature of about 70° F. and at a pH ranging from about 1.5 to about 2.0. The test panels are extracted from the operating bath, subjected to a tap water rinse and are thereafter contacted with the silicate rinse solution for about 30 seconds at a temperature of about 70° F. The silicate rinsed test panels are thereafter extracted from the rinse solution and are dried with recirculating warm air.

The test panels after drying are visually inspected and are observed to have a very hard clear yellow passivate film. The test panels after aging for at least 24 hours, are subjected to a neutral salt spray corrosion test according to ASTM Procedure B-117. The test panels thus treated in accordance with the present process exhibit excellent salt spray resistance after exposure for a period of more than 96 hours.

EXAMPLE 2

A series of trivalent chromium containing concentrates is prepared suitable for dilution with water to make up an operating bath in further combination with an oxidizing agent and cerium or lanthanum ions as follows:

| CONCENTRATE B | |
|---|---|
| Ingredient | Concentration, g/l |
| $Cr^{+3}$ | 24 |
| $CoSO_4.7H_2O$ | 25 |
| Ferrous ammonium sulfate | 12 |
| Sodium Fluoroborate | 15 |
| Succinic acid | 25 |
| Nitric acid (100%) | 60 |

| CONCENTRATE C | |
|---|---|
| Ingredient | Concentration, g/l |
| $Cr^{+3}$ | 24 |
| NaCl | 20 |
| Ferrous ammonium sulfate | 25 |
| Sodium succinate | 55 |
| Nitric acid (100%) | 60 |

| CONCENTRATE D | |
|---|---|
| Ingredient | Concentration, g/l |
| $Cr^{+3}$ | 24 |
| Ferric ammonium sulfate | 50 |
| Sodium succinate | 55 |
| NaCl | 20 |
| Nitric acid (100%) | 60 |

| CONCENTRATE E | |
|---|---|
| Ingredient | Concentration, g/l |
| $Cr^{+3}$ | 24 |
| Ferric ammonium sulfate | 50 |
| Succinic acid | 25 |
| NaCl | 20 |
| Nitric acid (100%) | 60 |

| CONCENTRATE F | |
|---|---|
| Ingredient | Concentration, g/l |
| $Cr^{+3}$ | 24 |
| Ferric ammonium sulfate | 50 |
| NaCl | 20 |
| Malonic acid | 25 |
| Nitric acid (100%) | 60 |

| CONCENTRATE G | |
|---|---|
| Ingredient | Concentration, g/l |
| $Cr^{+3}$ | 24 |
| $Fe_2(SO_4)_3$ | 30 |
| NaCl | 20 |
| Gluconic acid | 20 |
| Nitric acid (100%) | 60 |

| CONCENTRATE H | |
|---|---|
| Ingredient | Concentration, g/l |
| $Cr^{+3}$ | 24 |
| Ferric ammonium sulfate | 50 |
| NaCl | 20 |
| Maleic acid | 25 |
| Nitric acid (100%) | 60 |

A cerium ion concentrate is provided containing about 80 g/l ceric ions in the form of ceric sulfate in a dilute sulfuric acid solution. An oxidizing agent concentrate is also provided containing about 35% hydrogen peroxide. A series of operating baths is prepared suitable for forming a yellow passivate film on a substrate each containing 2% by volume of the cerium ion concentrate, 2% by volume of the oxidizing agent concentrate, and 2% by volume of one of the chromium concentrates A through G.

A lanthanum ion concentrate is provided containing about 60 g/l lanthanum ions in the form of a solution of lanthanum chloride. An oxidizing agent concentrate is also provided containing about 35% hydrogen peroxide. A series of operating baths is prepared suitable for forming a blue-bright passivate film on a substrate each containing 2% by volume of the lanthanum ion concentrate, 2% by volume of the oxidizing agent concentrate, and 2% by volume of one of the chromium concentrates A through G.

Zinc plated steel test panels as described in Example 1 are processed through each of the operating baths under the conditions as set forth in Example 1 whereafter the passivated panels are subjected to a silicate post-rinse treatment employing an aqueous silicate solution in which the silicate concentration is varied from about 1 to about 40 g/l calculated as $SiO_2$ at temperatures ranging from 50° to 150° F. The panels are subsequently air dried and subjected to a neutral salt spray corrosion test in accordance with Example 1. Similar results are obtained.

EXAMPLE 3

A series of operating baths is prepared containing:

| OPERATING BATH J | |
|---|---|
| Ingredient | Concentration, g/l |
| $Cr_2(SO_4)_3$ | 2.2 |
| $NH_4HF_2$ | .18 |
| $H_2SO_4$ | 1.2 |
| $H_2O_2$ | 5.3 |
| $FeNH_4SO_4$* | 0.25 |
| $CoSO_4.7H_2O$ | 1.6 |

*Ferrous Ammonium Sulfate = $Fe(SO_4).(NH_4)_2SO_4.6H_20$

| OPERATING BATH K | |
|---|---|
| Ingredient | Concentration, g/l |
| $Cr_2(SO_4)_3$ | 5.6 |
| $NH_4HF_2$ | 0.4 |
| $H_2SO_4$ | 2.7 |
| $H_20_2$ | 5.3 |
| $FeNH_4SO_4$ | 0.58 |
| $CoSO_4.7H_2O$ | 3.75 |

| OPERATING BATH L | |
|---|---|
| Ingredient | Concentration, g/l |
| $Cr_2(SO_4)_3$ | 3.0 |
| $NH_4HF_2$ | 0.24 |
| $H_2SO_4$ | 1.54 |
| $H_2O_2$ | 5.3 |
| $FeNH_4SO_4$ | 0.25 |
| $NiNH_4SO_4$* | 2.1 |

*Nickel Ammonium Sulfate = $NiSO_4.(NH_4)_2SO_4.6H_2O$

| OPERATING BATH M | |
|---|---|
| Ingredient | Concentration, g/l |
| $Cr_2(SO_4)_3$ | 3.0 |
| $NH_4HF_2$ | 0.24 |
| $H_2SO_4$ | 1.54 |
| $FeNH_4SO_4$ | 0.24 |
| $H_2O_2$ | 5.3 |
| $MnSO_4.H_2O$ | 1.0 |

| OPERATING BATH N | |
|---|---|
| Ingredient | Concentration, g/l |
| $Cr_2(SO_4)_3$ | 3.0 |
| $NH_4HF_2$ | 0.24 |
| $H_2SO_4$ | 1.54 |
| $FeNH_4SO_4$ | 0.24 |
| $H_2O_2$ | 5.3 |
| $H_2MoO_4.H_2O$ | 1.0 |

| OPERATING BATH P | |
|---|---|
| Ingredient | Concentration, g/l |
| $Cr_2(SO_4)_3$ | 3.0 |
| $NH_4HF_2$ | 0.24 |
| $H_2SO_4$ | 1.54 |
| $FeNH_4SO_4$ | 0.24 |
| $H_2O_2$ | 5.3 |
| $(NH_4)_4(NiMoO_{24}H_6)_4.4H_20$ | 1.0 |

Zinc plated test panels prepared as previously described in Example 1 are processed through the foregoing operating baths under the conditions previously described whereafter they are water rinsed and subjected to an aqueous silicate post-rinse treatment in a rinse solution in which the silicate concentration calculated as $SiO_2$ is varied from about 1 to about 40 g/l at temperatures ranging from about 50° to about 150° F. The passivated and post rinsed panels after drying are subject to salt spray tests as described in Example 1 and similar results are obtained.

While it will be apparent that the preferred embodiments of the invention disclosed are well calculated to fulfill the objects above stated, it will be appreciated that the invention is susceptible to modification, variation and change without departing from the proper scope or fair meaning of the subjoined claims.

What is claimed is:

1. A process for treating a receptive metal substrate to impart an improved chromate passivate film thereon which comprises the steps of providing an aqueous acidic solution containing chromium ions, substantially all of which are in the trivalent state, in an amount from about 0.05 g/l up to saturation, hydrogen ions in an amount sufficient to provide a pH of from about 1.2 to about 2.5, an oxidizing agent selected from peroxides, alkaline metal persulfates and ammonium persulfate, in an amount sufficient to activate the hydrated trivalent chromium to form a chromate film on the substrate, and at least one additional metal ion selected from the group consisting of iron, cobalt, nickel, molybdenum, manganese, aluminum, lanthanum, cerium, lanthanide mixtures, as well as mixtures thereof; contacting the substrate with said aqueous acidic solution for a period of time sufficient to form a passivate film thereon; contacting the passivated substrate with a dilute aqueous rinse for a period of at least one second, which rinse solution contains a bath soluble and compatible silicate compound present in an amount sufficient to impart improved corrosion resistance and hardness to the passivate film; and, thereafter, drying the passivated silicate rinsed surface.

2. The process as defined in claim 1 including the further step of water rinsing the passivated said substrate prior to contacting the passivated substrate with said aqueous silicate rinse solution.

3. The process as defined in claim 1 in which said aqueous solution contains from about 1 to 40 g/l of said silicate compound calculated as $SiO_2$.

4. The process as defined in claim 1 in which said aqueous rinse solution contains from about 5 to about 15 g/l of said silicate compound calculated as $SiO_2$.

5. The process as defined in claim 1 in which said silicate compound comprises an inorganic compound.

6. The process as defined in claim 5 in which said inorganic silicate compound comprises an alkali metal and ammonium silicate.

7. The process as defined in claim 1 in which said silicate compound comprises an organic silicate compound.

8. The process as defined in claim 7 in which said organic silicate compound comprises a quaternary ammonium silicate compound.

9. The process as defined in claim 7 in which said organic silicate compound is of a structural formula:

$$ROR':xSiO_2:yH_2O$$

wherein:

R is a quanternary ammonium radical substituted with four organic radicals selected from the group consisting of alkyl, alkylene, alkanol, aryl, alkylaryl, or mixtures thereof;

R' is R or H, x is an integer from 1 to 3, and y is an integer from 0 to 15.

10. The process as defined in claim 1 in which said aqueous rinse solution is at a temperature of about 50° to about 150° F.

11. The process as defined in claim 1 in which the step of contacting the passivated substrate with said aqueous rinse solution is carried out for a period of at least about one second up to about one minute.

12. The process as defined in claim 1 in which said rinse solution further contains from about 0.05 to about 5 g/l of a compatible wetting agent.

13. The process as defined in claim 1 in which said rinse solution further contains from about 1 to about 40 g/l of an emulsifiable oil.

14. The process as defined in claim 1 in which said rinse solution further contains an alkali metal and/or ammonium nitrite in an amount of about 0.1 to about 1 g/l.

15. The process as defined in claim 14 in which said rinse solution further contains a wetting agent in an amount of about 0.05 to about 5 g/l.

16. The process as defined in claim 1 in which said aqueous acidic solution contains trivalent chromium ions in an amount of about 0.2 to about 2 g/l.

17. The process as defined in claim 1 in which the pH of said aqueous acidic solution is about 1.6 to about 1.8.

18. The process as defined in claim 1 in which the pH of said aqueous acidic solution is about 1.5 to about 2.0.

19. The process as defined in claim 1 in which said aqueous acidic solution further contains sulfate ions in an amount up to about 15 g/l.

20. The process as defined in claim 1 in which said oxidizing agent in said aqueous acidic solution is present in an amount of about 1 to about 20 g/l calculated on a weight equivalent effectiveness basis to hydrogen peroxide.

21. The process as defined in claim 1 in which said oxidizing agent is present in said aqueous acidic solution in an amount of about 3 to about 7 g/l calculated on a weight equivalent effectiveness basis to hydrogen peroxide.

22. The process as defined in claim 1 in which said at least one additional metal ion in said aqueous acidic solution is present in an amount of about 0.5 to about 10 g/l.

23. The process as defined in claim 1 in which said aqueous acidic solution includes cerium ions present in an amount of about 0.5 to about 10 g/l.

24. The process as defined in claim 1 in which said aqueous acidic solution contains cerium ions in an amount of about 1 to about 4 g/l.

25. The process as defined in claim 1 in which said at least one additional metal ion is present in an amount of about 0.02 to about 1 g/l.

26. The process as defined in claim 1 in which said aqueous acidic solution further contains an organic carboxylic acid and compatible salts thereof present in an amount of about 0.05 to about 4 g/l.

27. The process as defined in claim 1 in which said aqueous acidic solution further contains halide ions in an amount up to about 2 g/l.

28. The process as defined in claim 1 in which said aqueous acidic solution further contains a bath compatible wetting agent present in an amount up to about 1 g/l.

* * * * *